United States Patent [19]

Fields et al.

[11] 4,441,761

[45] Apr. 10, 1984

[54] MINING MACHINE

[76] Inventors: Rush F. Fields, Box 83, Gilbert, W. Va. 25621; Buddy D. Fields, 6225 Highland Dr., Huntington, W. Va. 25705

[21] Appl. No.: 340,804

[22] Filed: Jan. 19, 1982

[51] Int. Cl.[3] ..... E01C 27/24; E01C 29/22

[52] U.S. Cl. ..... 299/64; 299/76; 175/319

[58] Field of Search ..... 299/64, 67, 76, 75; 175/319

[56] References Cited

U.S. PATENT DOCUMENTS

| | | | |
|---|---|---|---|
| 2,689,720 | 9/1954 | Cartlidge | 299/64 X |
| 2,797,065 | 6/1957 | Houston | 175/319 X |
| 2,976,027 | 3/1961 | Allimann | 175/319 X |
| 3,000,620 | 9/1961 | Densmore | 299/64 |
| 3,190,376 | 6/1965 | Christensen | 299/67 X |
| 3,860,291 | 1/1975 | Rauch | 299/67 |
| 4,082,362 | 4/1978 | Justice | 299/67 X |
| 4,205,881 | 6/1980 | Nitzberg | 299/67 X |

*Primary Examiner*—Nile C. Byers, Jr.
*Attorney, Agent, or Firm*—John S. Hale

[57] ABSTRACT

A mining apparatus which is adapted to be connected to a sectioned powered auger conveyor assembly and driven by the central shaft of the auger is constructed with its housing divided into a cutting section and an attachment section. A drive shaft is rotatably mounted to the cutting section and a transmission is mounted to the drive shaft, the transmission being adapted to receive an input shaft having one end coupled to the auger central shaft so that the auger shaft will turn the input shaft and drive the shaft through the transmission. A plurality of cutting arms are rotatably mounted on the drive shaft and are pivotally rotated around the drive shaft by a plurality of hydraulic cylinders to move the arms which carry an axle mounted therein on which cutting drums are mounted enabling the cutting drums to cut material from a seam of material. The cutter drums mounted on the axle are driven by a plurality of chains connecting the cutting drum axle to the drive shaft and a conveyor assembly is mounted under the arms and is also adapted to be driven by the drive shaft so that material fragments cut from the seam are deposited and carried onto the conveyor belt and transported along the conveyor belt into the auger conveyor which carries the material back through the auger conveyor to the desired site.

24 Claims, 8 Drawing Figures

Fig. 1
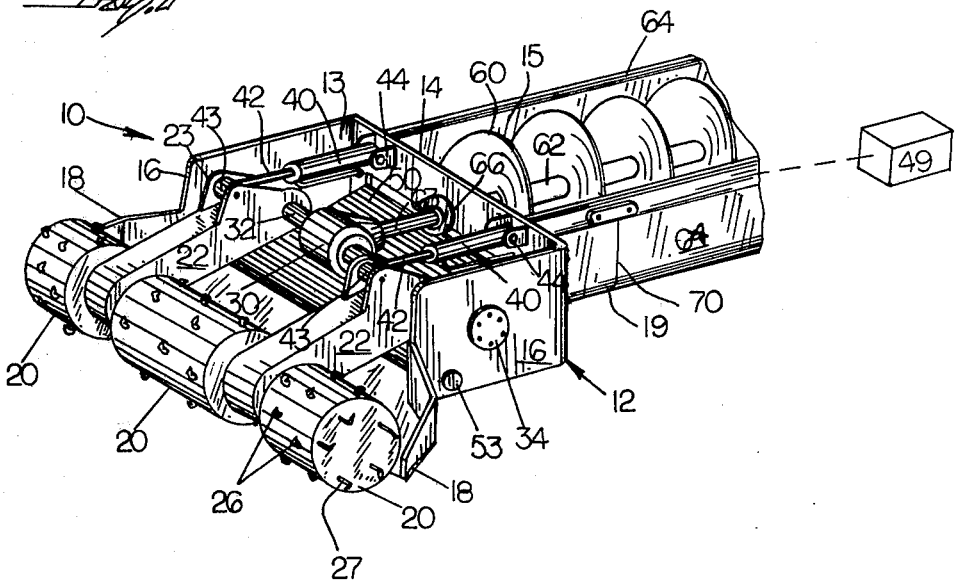
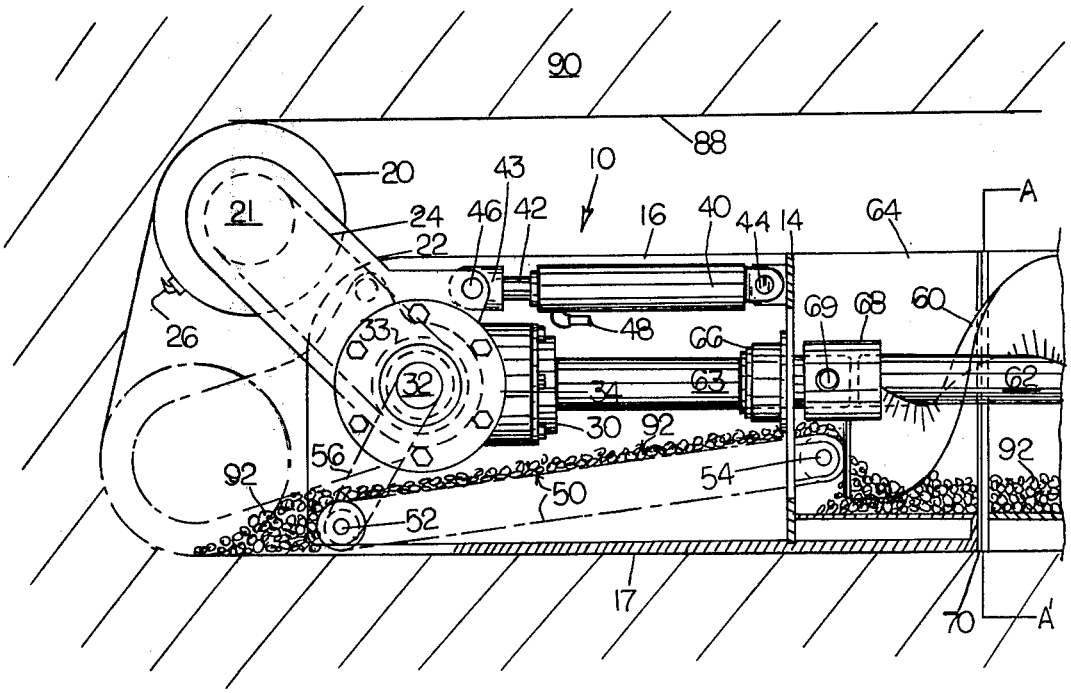
Fig. 2

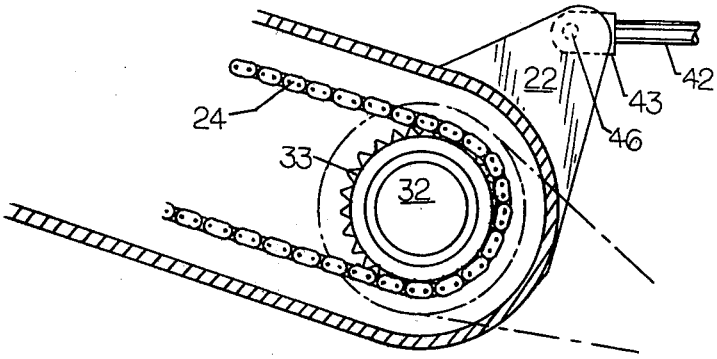
Fig. 5
Fig. 7
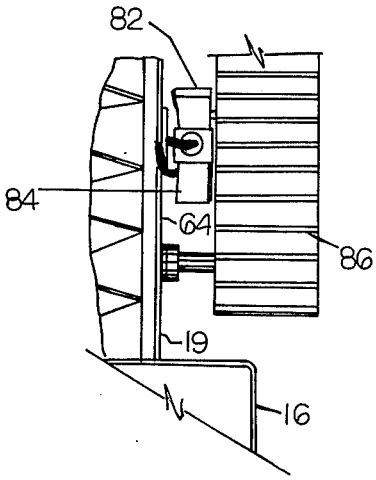
Fig. 6
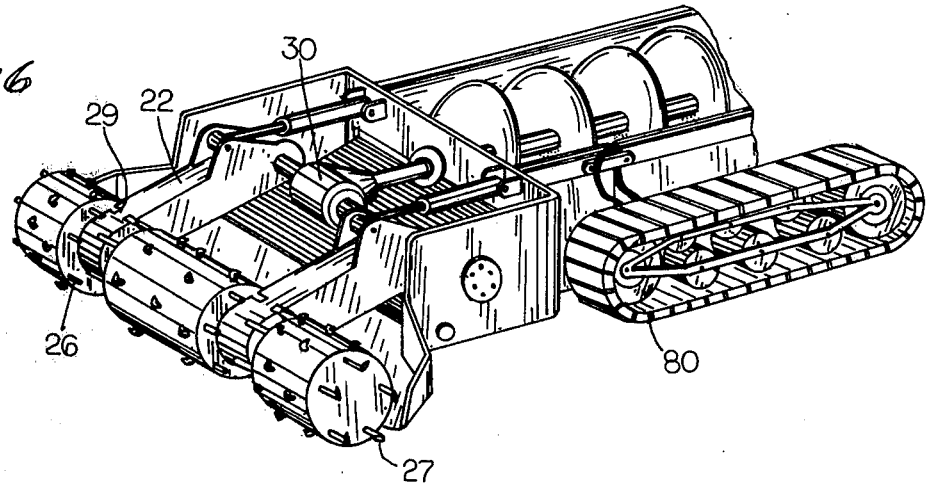
Fig. 8
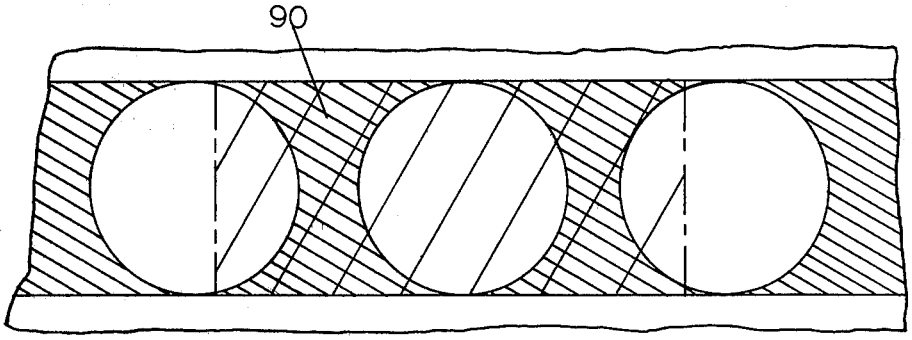

MINING MACHINE

BACKGROUND OF THE INVENTION

The present invention generally relates to mining machinery and more specifically to a mining machine adaptable to auger miners and constructed to retrieve unextracted coal or ore remaining from prior mining operations. The invention is also adapted to be used for original mining operations.

Coal is recognized as the most plentiful natural energy resource of general utility in many countries. However, coal has been a popular energy source for many decades and a great number of the richest coal fields have already been extensively mined. Coal is basically mined by two methods: surface mining and underground operations. The choice of method is dictated by many factors such as seam thickness, the depth and inclination of the seam, the location of the deposit, surface topography, economics and many other considerations. Surface mining is carried out by stripping away the strata overlying the coal seams and then removing the exposed coal. Over half the mining in the United States is accomplished in this manner. Thus, many surfaces have been strip mined leaving a large number of existing mined areas. Under certain conditions, a strip mining technique known as "auger mining" has been developed. The method comprises boring a series of parallel holes in coal seams which have been outcropped or have been exposed by removing overburden, leaving a highwall. The holes are cut by augers, large rotary drills ranging from two to five feet in diameter, which bore into the coal seam for some three hundred feet. The coal which is cut away by the auger is carried by the helical construction of the auger and is collected at the mouth of the hole. Augering machines are generally used where the thickness of the overburden is too great for removal but it can sometimes be used in an underground environment as well. Where auger mining can be used, it provides the most economical coal mining method.

As previously discussed, a typical conventional auger mining machine creates a bore of generally circular cross-section in a coal seam. Conventional auger miner devices are disclosed in U.S. Pat. Nos. 2,784,955; 3,105,677; 3,121,558; 3,190,698; 3,210,123; and 3,333,898, and a cutter head is discussed in U.S. Pat. No. 3,734,214. In auger mining, the auger is drilled into coal seams exposed by highwalls to remove the coal. The circular bores must be spaced far enough from each other to leave support pillars to prevent collapse of the seam. This spacing of circular holes typically leaves a significant amount of coal within the seam. In many mines, the circular bores are spaced much farther apart than is necessary to prevent collapse of the seam and the coal remaining in the seam is of high commercial value. In these mines, the maximum amount of coal is not recovered because of the shape of the bores and because the area or pillars in between the bores is wasted.

While the present application is directed toward the mining of coal, it will be appreciated that other ores or minerals which are found in seams or stratified deposits can also be mined. Consequently, the terms "ore", "minerals" or "materials" can be substituted for the term "coal", and use of the term "coal" should not limit the invention to this material, but should be considered to include all of the aforementioned materials.

A number of machines are known in the prior art for enlargement of circular bores or formation of rectangular bores. U.S. Pat. No. 4,082,362 discloses a mining machine with a circular boring head followed by two wing cutters, for horizontal enlargement of the initial circular bore. The cutters are driven in rotary fashion by cutting chains, which are in turn driven by a helical conveyor extending back to the mechanical power source. U.S. Pat. No. 1,880,091 discloses another mining machine with wing cutters, each cutter comprising a jaw with teeth on the periphery of the machine. The jaws are driven forward so that the teeth swing across the periphery of the bore and toward one another carrying with them coal scraped from the wall of the bore.

U.S. Pat. No. 1,978,366 discloses a dual chain-saw type mining machine. One chain-saw blade swings horizontally from a turret atop the machine and the other blade extends in front of the machine and is swung in a vertical plane.

Another type of mining machine comprises a rotary cutting drum extending forward from the machine. The drum is mounted on arms which transmit rotary power to the drum as well as lift the drum to cut coal above the height of the machine. The drums typically extend to the left and right of the width of the machine, so that a rectangular bore of substantial horizontal and vertical dimensions can be created by the cutting drum. Such machines are disclosed in U.S. Pat. Nos. 3,516,712 and 3,456,984.

A pertinent rotary cutting drum application is found in U.S. Pat. No. 3,712,679. This reference discloses a mining machine having a laterally extendable rotary mining head comprising a plurality of rotatable cutter support drums which are carried by a boom. The boom is pivoted on the housing and adapted to be moved by hydraulic cylinders. The cutting drums are powered by a pair of conventional rotary motors mounted on a catapillar vehicle. The coal cuttings are gathered by a gathering device comprising a gathering apron provided with gathering arms driven to direct material mined by the machine to a chain conveyor which carries the fragmented coal chips out to the entrance of the mine.

These prior art machines typically are constructed with a large number of moving parts which are subject to a high failure rate in a mining environment filled with dust. Machine failures in an underground environment are particularly difficult to rectify due to close quarters, lack of light, and lack of spare parts at hand. Further, such machines are typically quite expensive in single unit quantities. An article appearing on Page 7(d) of the *Charleston Gazette,* dated Friday, May 30, 1980, discusses a new thin seam coal mining machine which is reported in the article to sell for approximately two million dollars. A large portion of the cost of manufacturing such a machine lies in the provision of conveyor means and power supply which generally are already on hand at the normal mine site.

SUMMARY OF THE INVENTION

In accordance with the present invention there is disclosed a mining machine which is adapted to be connected to a conventional auger conveyor for removal of the cut coal and which uses the auger shaft for transmission of mechanical power to the mining machine. The machine is provided with rotary cutting drums mounted on an axle which may be lifted up and down the face of a coal seam by one or more lifting arms. Power to rotate the drums is provided from the auger conveyor shaft through a differential gear box to a drive shaft positioned substantially parallel to the cutting drum axle. The drive shaft drives a chain drive mounted within each of the lifting arms which rotates the driven or cutting drum axle held by the lifting arms. The drive shaft also drives a separate chain powering a conveyor belt which carries cut coal from the front edge of the mining machine to the auger conveyor. Power to lift the lifting arms may be supplied by a plurality of hydraulic cylinders attached to the lifting arms.

The machine according to the present invention results in an advantage of less wasted set-up time and the like for mining with a machine of a given size and the capacity to retrieve coal, ore and stratafied mineral deposits from previously mined areas. The invention is simply and sturdily constructed, symmetrical allowing for part reversal, and is easily extracted from cave-in sites or, in the alternative, left in the cave-in site with a lower machine loss cost than that of previous inventions.

There is a clear need in the art for a coal cutter mining machine which can remove more coal from a seam than that presently left by an auger device. The present invention approximately doubles tonnage production over that of conventional mining methods. Since it universally attaches to any existing auger, it would revamp the entire auger industry, making the industry more economically feasible. The invention can be adapted to mine at various depths and heights even below the twenty four inch present standard. At the present only those seams twenty four inches and higher are being mined.

The machine is of simplified construction with fewer moving parts subject to failure within the typical mining environment and the inherent problems of exposure to such conditions such as dust and water. As indicated, it can be readily attached to conventional conveying and power supply machinery on hand at the mining site. The invention also has no electrical components underground minimizing the danger of dust and gas explosions, and qualifies for permissibility under applicable Federal and States statutes. Since the invention does not require men working underground, work hazards would be greatly decreased.

These and other objects of the present invention will be more readily apparent from the following detailed description of the invention, accompanied by an inspection of the appended drawings, in which:

BRIEF DESCRIPTION OF THE DRAWINGS

FIG. 1 is a perspective view of the preferred embodiment of the present invention secured to an auger conveyor;

FIG. 2 is an enlarged side view of FIG. 1 partially in phantom showing the invention in operation within a coal seam;

FIG. 5 is an enlarged partial cross-sectional view of the arm housing, cylinder yoke and chain drive;

FIG. 6 is a perspective view of an alternate embodiment of the present invention;

FIG. 7 is a partial top plan view of the track and motor of the embodiment shown in FIG. 6; and FIG. 8 is a view of a previously auger mined seam with the mining range of the present invention shown in phantom.

DETAILED DESCRIPTION OF THE DRAWINGS

Figure 3:
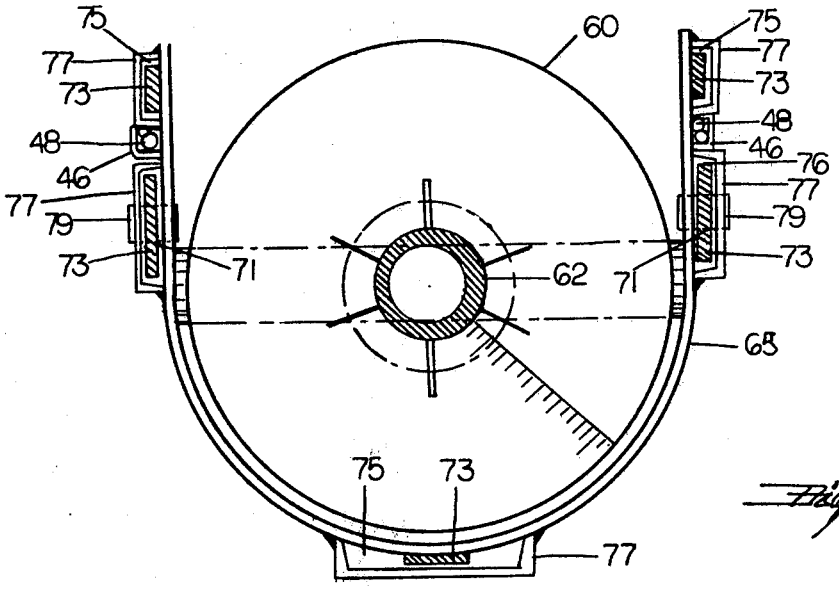
FIG. 3 is a cross-sectional view of the apparatus as seen in FIG. 2 at line A—A', showing the manner in which the present invention is linked to a conventional auger conveyor.

The preferred embodiment and best mode of the invention is shown in FIGS. 1 through 5 and an alternate embodiment is shown in FIGS. 6 and 7.

Referring to FIGS. 1 and 2, the mining machine is generally indicated at 10 and comprises a housing 12 having a rear wall 14, side walls 16, a base 17, a scoop 18 and rear side walls 19. The housing 12 for convenience of discussion is divided into a front cutting section 13 and a rear attachment section 15. Cutting drums 20 are fixedly mounted on axle 21 which is carried by pivotal arms 22. The drums 20 are coaxially mounted on the axle 21 for rotation therewith by annular drum mountings which at their inner surface may be splined or otherwise suitably affixed to the axle 21 and along their outer circumferences are welded, grooved or otherwise affixed to the inner surface of the drums. The pivotal arms 22 are pivoted about drive shaft 32 journalled in the side walls 16 to move the cutting drums 20 up and down along the face of a coal seam 90. The pivotal arms are each constructed of a relatively thin cross-section to facilitate the employment of the outwardly angled cutter bits 26 for cutting along the spaces between the drums. The cutting drums 20 are covered with a plurality of peripheral cutting bits or teeth 26 and end cutting teeth 27 which are adapted to contact the face of the coal seam 90 and reduce the contacted coal to coal fragments 92.

The cutting drums 20 are rotated by drive belts or chains 24 which are housed within arms 22 and which are shown in phantom in FIG. 2. The chains 24 are mounted on drive sprocket 33 fixedly mounted to drive shaft 32 and on a driven sprocket (not shown) mounted on axle 21. While drive chains are preferred to increase the bite of the cutting drums into the coal seam, drive belts or V-pulleys or other standard state-of-the-art mechanisms can also be used and are effective in reducing spark potential. The chains or belts 24 are enclosed by the arm housings in order to contain sparks caused by metallic friction. The chains and belts can also be coated to prevent metallic friction, or be constructed of high strength plastics or non-metal materials.

The cutting teeth 27 on the outer periphery of drums 20 project outwardly to cut along the spaces between the drums and no cutting chains or other auxilliary cutting or breaking means need be provided between the laterally adjacent drums. As can be seen in FIG. 6, the arm housings 22 can be channeled 29 to allow easy passage of these outwardly projecting teeth. Where the arm housings are around four inches or less, the coal pillars that would be formed in front of the arms are normally ripped away and there is no need for the extended cutter teeth or channels 29. It is also envisioned that a spiral cutting blade could be used for various mining operations and that the cutter teeth could be individually replaceable. Alternatively, the end of the arm housing 22 may be exposed when the drive chains are cutting chains although in the preferred embodiment, the arm housing is enclosed and chains 24 are normal drive chains. If a cutting chain is used, it may be of any conventional type such as Cincinnati Rop-Lok Chain No. 1997. Drive shaft 32 is driven by input shaft 63 through sealed transmission 30.

Coal fragments 92 cut from coal seam 90 are gathered by a scoop member 18 and pushed onto conveyor 50. The scoop 18 is preferably positioned under the cutter arms and a rear portion of the cutter drums 20. The scoop has a bottom portion which abuts the seam floor and side portions that funnel inward toward the conveyor 50. The conveyor 50 is of the endless belt type rotating around a driven belt shaft 52 adjacent the scoop 18 and free-wheeling shaft 54 adjacent a sectioned auger conveyor 60. The driven shaft 52 is driven by conveyor drive belt or chain 56 which in turn is driven by the drive shaft 32.

As shown in FIG. 2, the conveyor belt 50 rotates to carry coal fragments 92 away from the scoop 18 and deposit the fragments on the sectioned auger conveyor 60. Vertical side walls 16 are positioned beside the conveyor 50 to prevent coal fragments 92 from falling off the conveyor belt into the mining machine 10. Side walls 16 also support drive shaft 32 in journals 34 and conveyor shaft 52 in journals 53. Conveyor belt 50 passes through an aperture cut in rear wall 14 and deposits coal fragments 92 in the auger conveyor 60. The rear wall 14 secured to the side walls 16 supports powered input shaft 63 within a shaft seal member 66, and also supports hydraulic cylinders 40 which lift and move arms 22. The base of each hydraulic cylinder 40 is mounted in a cylinder pivot seat or yoke 44 which is in turn mounted on rear wall 14. The end of the piston arm 42 of hydraulic cylinder 40 has a pivot head 43 secured thereto which is mounted around pivot axle 46 attached between ears 23 of arm 22. Thus, when hydraulic cylinder 40 is actuated so that the shaft 42 extends therefrom, the arm 22 will be forced down the seam 90. When hydraulic cylinder 40 retracts piston arm 42, the arms 22 will be lifted up the face of the seam 90. The hydraulic cylinders 40 are activated through pressure lines 48 in a manner well known in the art. The lines or hoses 48 are connected to a fluid reservoir schematically indicated by box 49.

The side walls 19 of the rear attachment section 15 are secured to the back of rear wall 14 and base 17 forming a housing section for attachment to a similarly configured conventional auger conveyor section 64. A shaft coupling 68 is mounted on the input shaft 63 in the mining machine 10 to engage the powered shaft 62 of the auger conveyor 60. The coupling 68 is illustrated as a conventional pin and collar arrangement although any conventional arrangement which transmits rotational momentum will serve equally well.

Figure 4:
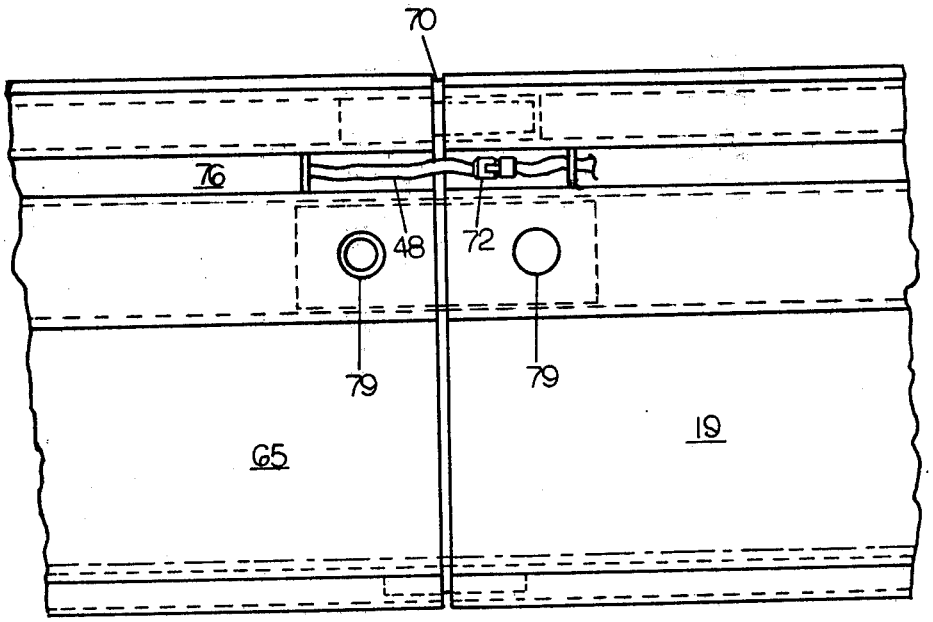
FIG. 4 is a partial enlarged side view of the apparatus of FIG. 1 showing the exterior linkages for the hydraulic cylinder lifting means.

Referring now to FIGS. 3 and 4, a means is illustrated for securely linking side walls 19 with the conveyor section 64. The auger conveyor 60 rests within the attachment section 15 and the side walls of the conveyor section 64 and is supported in a manner known in the art. Walls 19 and the conveyor section 64 meet at seam 70. Hydraulic lines 48 which control the cylinders 40 shown in FIGS. 1 and 3, extend along the length of walls 19 and conveyor section 64 in a closed exterior conduit or housing 76. In the vicinity of seam 70, conduit 76 may be terminated so that the pressure lines 48 are exposed for purposes of linkage across the seam 70. The linkage may be provided through any conventional fluid connector 72 such as quick disconnect couplings. Thus, the pressure lines 48 may extend from the mining machine 10 to a remote fluid reservoir 49 and operation of the hydraulics can be accomplished by standard state-of-the-art technology.

A plurality of hollow rectangular bracket members 77 are secured to the outside of walls 19 and conveyor section 64 for purposes of mechanical linkage. Each bracket member 77 defines a chamber 75 within it adjacent to wall 19 or conveyor section 64. Rectangular shaped bars 73 are secured within the member 77 so as to extend therefrom across seam 70. Rectangular bracket member 77 and corresponding bars 73 and the associated walls may define throughgoing threaded holes which may be aligned to allow the insertion of threaded pins 79 to hold the housing 12 and conveyor sections 64, 65 adjacent to one another in the proper relationship for operation of the mining machine 10 and auger conveyor 60.

An alternate embodiment of the invention is shown in FIGS. 6 and 7. In this embodiment, the arms 22 are channeled at 29 to allow blades 26 to pass therethrough so that a pillar of coal would not be left in front of the mining machine. The alternate embodiment is also provided with hydraulically powered tracks 80 which allow the mining machine to be driven three hundred to three hundred and fifty feet back into the coal seam, thus providing an extended mining range.

The tracks 80 of a tracked vehicle are driven by means of hydraulic motors 82. The use of hydraulic motors allows each track to be independently driven and eliminates the need for complex drive shafts and gearing. Each motor is connected to the power unit by means of small bore piping, which can be seen in FIG. 7.

Hydraulic motors are similar in construction to rotary pumps, two common types being gear motors and vane motors. The present invention can utilize either a gear motor or a vane motor. A gear motor, like a gear pump, consists of two intermeshing gearwheels in a closely fitting housing having an inlet and an outlet port. Hydraulic liquid under pressure is fed to the inlet port and passes between the gear teeth and the motor housing to the outlet, thus driving the gearwheels which are coupled to the mechanism to be driven. A vane motor has a rotor fitted with a number of movable, radially extending vanes which are spring loaded to press against the motor housing. The rotor is eccentrically mounted in the motor housing 84. Hydraulic liquid under pressure is introduced through an inlet on one side of the rotor, passes between the rotor and the housing, thus driving the rotor around, and the leaves the motor through an outlet on the other side of the rotor.

The present mining invention is particularly designed to extract the remaining coal once an auger operation is completed. After the auger mining has been completed, the coal strata will appear as shown in FIG. 8. The auger motor and power plant situated outside of the actual mine site will remain in place for attachment with the mining machine. The mining operation begins with the power plant and motor on the outside, as would be the standard operating procedure if an auger mining apparatus were used. The first section to start the mining operation would be the attachment of the mining machine to the auger power plant as shown in FIGS. 1 and 2 in the same manner as an auger bit or shaft would have been attached. The arms 22 that hold the cutting heads or drums are selected according to predesignated length before the machine starts underground, thus the height of the coal seam will determine the length of the mining head arms. It can thus be seen that varying sized arms can be readily substituted in the invention to accomodate the size of the seam although in most instances the vertical lift of the arms is controlled to the height desired through the operator controlled hydraulic cylinders 40. The carriage of the auger power plant (not shown) is standard and well known in the art with its forward and backward motion allowing for the insertion of additional sections. The carriage provides the source of mobility for the mining operation. The mining machine is attached to the shaft 62 of the auger conveyor and attaches in the same manner as an auger is presently attached, namely with a male/female interlocking linkage. The mining machine is lifted into place with a boom situated at the power plant, the boom normally being used to lift the auger sections 65 into place. When the mining machine 10 is positioned adjacent the seam by the boom and is prepared for use, the rear of the housing (section 15) is placed against the front of a conventional auger conveyor section 64 so that its rear side wall 19 abut the front walls of the conveyor housing with shaft 62 moving into the coupling 68 as previously indicated. Bars 73 are extended through members 75 in the walls 19 conveyor section 64 across the joint 70. Threaded inserts 79 may be inserted in the threaded pinhole to maintain connection of the walls 19 and conveyor section 64. A link pin 69 is inserted through coupling member 68 and input shaft 63 so that shaft 63 is forced to rotate with shaft 62. Fluid pressure lines 48 are connected across auger joint 70 by means of a quick disconnect coupling.

After initiating the power supply to the auger drive motor, the motor starts to turn, thus turning the auger shaft 62 which is situated in its housing. The auger conveyor shaft 62 when rotated drives the drive shaft 32 by way of transmission 30. As the auger shaft turns, the carriage is moved forward and forces the cutting drums 20 against the coal seam. The auger serves two purposes, namely that it is the power source for the mining cutting head, and that it is also used as a conveyor to transport the coal cut by the mining head to the outside. Here the coal pieces will be loaded exactly as if it were a regular auger operation.

The shaft 62 is suspended between side walls of the housing 64 so that coal fragments can pass under it. The drive shaft 32 passes through the transmission 30 much in the same manner as the rear end suspension on an automobile. The arms 22 of the apparatus are rotatably mounted to the drive shaft 32 and mounted inside the arm housings are respective sprockets and chains to turn axle 21 and its associated cutting drums 20. As the coal is cut by the teeth or bits 26 and 27 of the rotating drums the endless belt conveyor 50 carries the coal back to the auger conveyor 60 and the auger conveyor carries the coal back outside. The conveyor 50 is preferably not more than four or five feet in length. As the clockwise motion of the auger shaft 62 turns the transmission, the blades 60 mounted on the auger shaft 62 inside the housing sections 64, 65 are angled to deliver coal back to the entrance of the seam behind the mining machine. A similar function occurs when an electric drill bit makes a hole and delivers the loose wood to the outer surface of the drill hole.

The oscillating motion of the drums is caused by hydraulic or pneumatic cylinders 40 which are placed on either side of the apparatus. The cylinders' expansion will force the arms and their respective cutting drums upward and retraction will cause the mining head to lower. The cylinders require a standard intake and return line for the fluid. The hydraulic lines 48 are laid against the walls of the auger tray sections 64, 65 and are covered with protective metal covers 46. The lines are also provided with quick disconnect couplings at the beginning and end of each auger section that is placed together. The lines are in turn connected to a hydraulic fluid reservoir 49 in the power plant situated outside. Once the rotation of the cutting drums 20 has begun, the rotation of the cutting drums 20 brings the cutting teeth or bits 26 into contact with the surface of seam 90 and produces coal fragments 92 which fall into the scoop or pan 18. As the mining machine is pressed forward into the coal seam by the forward motion of the carriage, the coal fragments 92 are forced from the scoop 18 back to the conveyor 50 and are conveyed over the endless belt into the auger conveyor 60.

The rate of delivery of coal fragments 92 may be regulated by the rate of spin of the cutting drums 20 which is in turn controlled by the rotational speed of the conveyor shaft 62. The height of the cut shaft 88 produced in the seam 90 by the mining machine 10 may be regulated by lifting the arms 22 to carry the cutting drums 20 up and down across the face of the seam 90. As previously indicated, the arms 22 can be varied in size to accomodate the height of the seam 90. In operation, the arms 22 pivot vertically around drive shaft 32 by expansion of the hydraulic cylinders 40 which are activated by pressure delivered through pressure lines 48. The operation of the cylinder is controlled by an operator outside of the cut shaft.

The length of the arms 22 and the lifting power of the hydraulic cylinders 40 determines the mechanical limits of the cut. Once the first section 64 of the auger conveyor is transported underground, the cutting action of the machine is terminated by stopping rotation of the auger shaft 62. The coupling of the male/female connection between auger shaft section 62 and the motor shaft of the power plant is broken by the rearward motion of the carriage of the power plant. The boom then lifts up a second conveyor section 65 and places the second section in place behind the previous section. The third, fourth and following sections 65 are laid and connected exactly as the second section. As indicated, the front of the second section 65 will match up to the back of the leading section 64 with the auger shaft interlocking in a male/female connection or coupling. Pins are dropped in place on either side of the auger housing trays and hydraulic hoses 48 are connected with quick coupling joints. The back of the last auger section will connect to the motor shaft of the power plant and the hydraulic lines will connect to the reservoir in the power plant. The power plant begins its rotation again by initiating the machine functions as previously described.

Once the desired mining depth is achieved, the sections can be extracted from the coal seam by manual disconnection of each section and the hydraulic lines when the carriage of the power plant makes its rearward motion.

When the mining machine has progressed over 150 to 200 feet into the seam, the carriage may not be strong enough to propel the machine forward. In such circumstances, it may be necessary to utilize the embodiment shown in FIGS. 6 and 7. The use of hydraulically powered catapillar tracks powered by a fluid pumped off of the hydraulic fluid lines 48 can allow the mining apparatus to penetrate over 300 feet into the coal seam. If a reversable valve is used in the fluid pump, a reverse flow of fluid can be used to reverse the direction of the tracks allowing the apparatus to be easily retracted from the mine.

In the foregoing description, the invention has been described with reference to the particular preferred embodiment although it is to be understood that the specific details shown are merely illustrative, and that the invention may be carried out in other ways without departing from the true spirit and scope of the following claims.

What is claimed is:

1. A remotely operated mining apparatus adapted to mine seams of material such as coal, ore or the like comprising: a housing, a powered shaft mounted to said housing, drive means connected to said powered shaft, lifting means mounted to said housing, said lifting means being adapted to lift cutting drums mounted thereto along the face of a seam to produce cutting of the material in the seam, each of said cutting drums being provided with cutting teeth adapted to contact and cut said seam material; transfer means connecting said powered shaft to said cutting drums, said transfer means being adapted to transfer said powered shaft's movement to rotate said cutting drums, and conveyor means mounted to said housing to carry materials cut by said cutting drums to said drive means which functions as a second conveyor.

2. The apparatus of claim 1 wherein said drive means is a helical conveyor with a central shaft.

3. The apparatus of claim 1 wherein said conveyor means is connected to and driven by said powered shaft.

4. The apparatus of claim 1 wherein said lifting means comprises a plurality of lifting arms mounted on said powered shaft, said powered shaft being positioned substantially parallel to the axis of rotation of said cutting drums and journalled in said housing, said lifting arms being adapted to pivot about said powered shaft, and cylinder means connected to said lifting arms for rotation of said lifting arms about said powered shaft.

5. The apparatus of claim 4 wherein said cylinder means are a plurality of hydraulic cylinders, a fluid reservoir and conduits connecting and allowing communication between said cylinders and said reservoir.

6. The apparatus of claim 1 including transmission means mounted on said powered shaft and engaging said drive means, said transmission means comprising a gear box for supplying energy from said drive means to said powered shaft.

7. The apparatus of claim 4 wherein said transfer means comprises secondary drive means, said secondary drive means being enclosed within said lifting arms and adapted to transfer said rotational energy from said powered shaft to said cutting drums.

8. The apparatus of claim 7 wherein said secondary drive means is a belt drive assembly.

9. The apparatus of claim 7 wherein said secondary drive means is a chain drive assembly.

10. The apparatus of claim 1 wherein said conveyor means is a conveyor belt rotating about a driven shaft and a freewheeling shaft, said driven shaft being driven by chain drive means mounted to said powered shaft.

11. The apparatus of claim 5 wherein said cylinder means is connected to a pressure conduit means operable from an operator-controlled source outside of said mine shaft.

12. In a mining machine, the combination of a sectioned powered auger conveyor and a portable cutter assembly removably mounted to said auger conveyor, said cutting assembly comprising a housing, a drive shaft rotatably mounted to said housing, transmission means mounted on said drive shaft, said transmission means transmitting the drive of a central shaft of the auger conveyor to rotate said drive shaft, a plurality of arm housings moveably mounted on said drive shaft, a cutter head axle rotatably mounted in the distal ends of said arm housings, and being positioned substantially parallel to said drive shaft, linkage means mounted within said arm housings adapted to drive said cutter head axle from said drive shaft, a plurality of cutting members mounted on said cutter head axle and driven thereby, each of said cutting members comprising a drum with cutting blade means mounted thereon, means mounted to said housing to engage said arm housings to pivot said housing arms upwardly and downwardly around a pivot point formed by said drive shaft and conveyor means mounted to said housing at least a portion of which is beneath said arm housings, said conveyor means being connected to said drive shaft by a second linkage means and being driven by said drive shaft to carry cuttings produced by said cutting drums to the rear of said housing into said auger conveyor.

13. The mining machine of claim 12 wherein said arm pivot means comprises fluid cylinder means, fluid cylinder conduit lines connected to said fluid cylinder means, and a fluid reservoir communicating with said fluid cylinder means via said lines.

14. The mining machine of claim 12 including a hydraulic driven catapillar track means mounted immediately behind said housing on the front of said auger conveyor, said hydraulic driven catapillar track means being adapted to advance or retract said cutting assembly.

15. The mining machine of claim 12 including adapter means mounted to said cutter assembly housing allowing said cutter assembly housing and the front section of said powered auger conveyor to be removably secured together.

16. The mining machine of claim 12 wherein said auger conveyor and cutter assembly housing are provided with channel means to carry hydraulic lines.

17. The mining machine of claim 12 wherein said transmission means includes an input shaft provided with coupling means which can be coupled to the shaft of said poweredauger conveyor.

18. The mining machine of claim 12 including a scoop structure secured to said cutting assembly housing, said scoop structure being formed with upturned flange sides and funneling inward to direct cuttings from said cutting drums onto said conveyor.

19. The mining machine of claim 12 wherein said cutting drums are provided with cutting blades at their end surfaces.

20. The mining machine of claim 12 wherein the cutting blades of adjacent drums extend past the edge of the drums to cut a width of material in excess of the width of the cutting drum.

21. A mining apparatus adapted to be connected to a sectioned powered auger conveyor assembly and driven thereby comprising a housing comprising a cutting section and an attachment section, a drive shaft rotatably mounted to said cutting housing section, transmission means mounted to said drive shaft and including an input shaft connected to said transmission means and extending from said cutting housing section into said attachment section; coupling means mounted on the end of said input shaft, said coupling means being adapted to couple said input shaft with the central shaft of said auger conveyor so that said auger conveyor shaft will turn said input shaft and drive said drive shaft through said transmission means, cutting arms rotatably mounted on said drive shaft, cylinder means mounted to said cutting housing section and connected to said cutting arms adapted to selectively rotate said cutting arms around said drive shaft, said cylinder means having fluid lines connected thereto which run along said housing and said auger conveyor structure back to a fluid reservoir remotely located from said cylinder means, means to selectively supply fluid to said cylinder means, a cutter drum axle mounted to said cutting arms, a plurality of cutter drum members mounted on said axle and adapted to be driven by drive means connecting said cutting drum axle with said drive shaft, each of said cutter drum members being provided with cutter means adapted to cut into material such as coal, ore or the like and shear such material from its respective seam or deposit, and conveyor means extending from said cutting housing section into said transfer section, said conveyor means comprising an endless belt and being driven by said drive shaft so that material fragments cut from the seam or deposit are carried onto said conveyor belt and transported along said conveyor belt into the auger conveyor which carries the material back through the auger conveyor back to the desired site.

22. An apparatus as claimed in claim 21 wherein said cutting housing section includes a scoop member positioned under said arms and configured so that it funnels material cut by said cutter drums inward onto said conveyor means.

23. Apparatus as claimed in claim 21 including self-propelled catapillar track means mounted on the front section of the powered auger conveyor, said powered catapillar track means being powered by a fluid motor which receives fluid from said fluid lines.

24. Apparatus as claimed in claim 21 including means to secure the attachment section of said housing to the front section of said powered auger conveyor to hold said powered auger conveyor and said housing in a secured relationship.

* * * * *